United States Patent [19]

Bernstein

[11] 4,185,816

[45] * Jan. 29, 1980

[54] SIT-UP EXERCISE APPARATUS

[76] Inventor: Morton J. Bernstein, 3636 Graystone Ave., Bronx, N.Y. 10463

[ * ] Notice: The portion of the term of this patent subsequent to Sep. 25, 1995, has been disclaimed.

[21] Appl. No.: 857,612

[22] Filed: Dec. 5, 1977

Related U.S. Application Data

[63] Continuation-in-part of Ser. No. 777,638, Mar. 15, 1977, Pat. No. 4,116,434.

[51] Int. Cl.[2] ..... A63B 23/02

[52] U.S. Cl. ..... 272/93; 272/900; D21/95

[58] Field of Search ..... 248/224.3, 224.4; 272/900, 145, 93, 116, 143, 109, 120, 144; D34/5 K, 96

[56] References Cited

U.S. PATENT DOCUMENTS

| | | | |
|---|---|---|---|
| 680,556 | 8/1901 | Wieland | 272/900 |
| 1,276,845 | 8/1918 | Wheary | 248/224.4 |
| 1,953,857 | 4/1934 | Hunter | 272/145 |
| 2,050,652 | 8/1936 | Fleming | 272/900 |
| 2,190,895 | 2/1940 | Turpin | 272/900 |
| 2,253,758 | 8/1941 | Bulloch | 272/93 |
| 2,425,971 | 8/1947 | Walker | 272/900 |
| 3,134,592 | 5/1964 | Sharkey | 128/84 R |
| 3,369,786 | 2/1968 | Schloemer | 248/224.3 |
| 3,850,430 | 11/1974 | Hamilton | 272/143 |
| 4,116,434 | 9/1978 | Bernstein | 272/900 |

*Primary Examiner*—Richard J. Johnson
*Attorney, Agent, or Firm*—Leonard W. Suroff

[57] ABSTRACT

A sit-up exercise apparatus adapted to be utilized in conjunction with a door having spaced apart vertically extending surfaces and a bottom intermediate the surfaces. The apparatus comprises a frame having oppositely disposed sides and adapted to be removably secured to the door. The frame includes an elongated base adapted to extend below the bottom of the door, and front and rear members, each one of the members having an oppositely disposed lower end connected to the base and an upper end with spaced apart inner and outer walls intermediate the ends. The inner walls adapted to extend in overlapping relation with the surfaces of the door. The inner walls oppositely disposed with respect to each other defining a space therebetween greater than the width of the door defined by the surfaces so as to readily permit the positionment of the door therebetween. A clamp is operatively connected to one of the members and extends inwardly of the inner wall for releasably clamping one of the surfaces of the door, such that the frame is fixedly secured to the door at a selected position thereon and may be readily removed from securement therewith by releasing the clamp. A removable support extends outwardly from one of the members on the frame and is adapted to extend at a height above the base so as to be readily engageable by the insteps of the user of the sit-up exercise apparatus. A coupling assembly is provided for releasably securing the support to the frame.

13 Claims, 6 Drawing Figures

SIT-UP EXERCISE APPARATUS

CROSS REFERENCE TO RELATED APPLICATION

This application is a continuation-in-part of my co-pending patent application Ser. No. 777,638 filed Mar. 15, 1977, now U.S. Pat. No. 4,116,434, issued Sept. 26, 1978 which entire subject matter of the co-pending application is incorporated herein by reference as if fully set forth herein.

BACKGROUND OF THE INVENTION

1. Field of the Invention

The present invention relates to a sit-up exercise apparatus to facilitate the exercising of the abdominal muscles by male and female users thereof.

The need for exercise has become amply documented over the last decade, and a device to assist individuals in performing exercise at home is a most important implement in an exercise routine. The ability to perform sit-ups is a most important part of any exercise routine in physical conditioning.

2. Description of the Prior Art

The prior art has appreciated the need to restrain the instep portion of the foot when performing a sit-up exercise to strengthen the abdominal muscles. As disclosed in U.S. Pat. No. 1,953,857 to Hunter, there is provided a device which is positioned on the floor and requires the user thereof to have his or her body extend thereacross. This provides a problem of storage as well as the need to purchase a support panel which is not necessary for performing the sit-up exercise.

An ideal solution to a sit-up exercise apparatus would be a device that is readily transportable, and one such device is disclosed in U.S. Pat. No. 2,050,652 to Fleming. But Fleming utilizes a complicated structure for securement of the floor exercise device between the underside of a door and the floor.

Another solution to a foot-restraining device is disclosed in U.S. Pat. No. 3,134,592 to Sharkey for use on the foot board of a bed. The construction in Sharkey does not lend itself for use on a door or the like.

I have discovered that it is possible to provide a sit-up exercise apparatus that is readily secured to a door without marring same and still permit certain adjustments to the portion of the apparatus against which the feet of the user are retained during the exercise. The advantages and distinctions of my invention over the prior art will become more clearly evident as the disclosure proceeds.

OBJECTS OF THE INVENTION

An object of the present invention is to provide a sit-up exercise apparatus that is adapted to be readily secured to a door and quickly released therefrom.

Another object of the present invention is to provide a device for facilitating exercising of the abdominal muscles, that is of a rigid character and capable of being removably secured to a door.

Another object of the present invention is to provide a sit-up device which may be formed from metal having clamping means associated therewith for securement to the bottom of a door such that the user may lie in a flat position with the legs of the user retained in place by the device.

Another object of the present invention is to provide a sit-up exercising apparatus in which the supporting means portion thereof for engaging the instep of the person's feet is removable from the frame of the apparatus such that the supporting means is readily secured to and removed from the frame.

Other objects and advantages of the present invention will become apparent as the disclosure proceeds.

SUMMARY OF THE INVENTION

A sit-up exercise apparatus adapted to be utilized in conjunction with a door having spaced apart vertically extending surfaces and a bottom intermediate the surfaces. The apparatus comprises frame means having oppositely disposed sides and adapted to be removably secured to the door, with the frame means comprising a base having spaced apart terminal ends extending in a plane substantially parallel to the surfaces of the door. The base is adapted to extend below the bottom of the door.

A front member is provided having an oppositely disposed lower end and an upper end and spaced apart inner and outer walls intermediate the ends. The lower end extends upwardly from the base along the terminal end, and the inner wall is adapted to extend in overlapping relation with one of the surfaces of the door.

A rear member is provided having an oppositely disposed lower end and an upper end and spaced apart inner and outer walls intermediate the ends. The lower end extending upwardly from the base along the terminal end, and the inner wall adapted to extend in overlapping relation with one of the surfaces of the door.

The inner walls are oppositely disposed with respect to each other defining a space therebetween greater than the width of the door defined by the surfaces so as to readily permit the positionment of the door therebetween. In this manner the frame extends below and on each side of the door.

Engaging means is secured to the inner wall of one of the members and has a contacting edge so as to provide a surface for engaging one of the surfaces of the door. Clamping means is operatively connected to the other one of the members and extends inwardly of the inner wall for releasably clamping the other one of the surfaces of the door, such that the frame is fixedly secured to the door at a selected position thereon and may be readily removed from securement therewith by releasing the clamping means.

Supporting means extends outwardly from one of the members on the frame means and is adapted to extend at a height above the base so as to be readily engageable by the feet of the user of the sit-up apparatus. The supporting means comprises a support element extending in a plane substantially parallel to the member for engagement by the feet of the user of the sit-up apparatus, and a bracket extends between the support element and the member so as to rigidly retain the support element in fixed relationship to the frame means.

In accordance with one embodiment of the invention coupling means is provided for releasably securing the supporting means to the frame means so as to permit the supporting means to be disassembled therefrom when the sit-up apparatus is not in use with the frame means remaining assembled with the door. This permits one portion of the apparatus to remain secured to the door while the door is normally in use.

In accordance with another embodiment of the present invention the supporting means is pivotally connected by the coupling means to the frame means for movement between an operative position for use of the device, to an inoperative position for storage of the device.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DETAILED DESCRIPTION OF THE DRAWINGS

Figure 1:
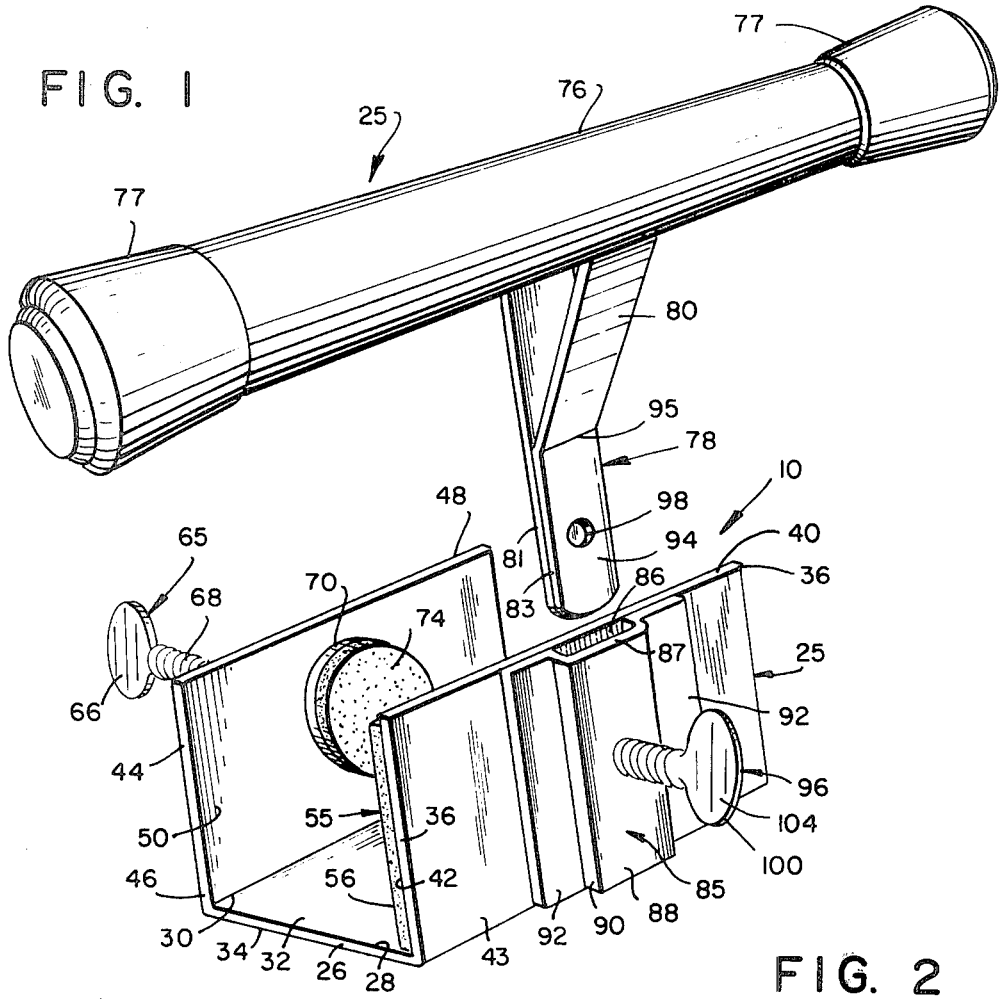
FIG. 1 is a perspective view of the sit-up exercise apparatus in accordance with the present invention.

Referring to the drawings, there is illustrated in FIGS. 1–4 one embodiment of a sit-up exercise apparatus 10 adapted to be utilized in conjunction with a door 12 having spaced apart vertically extending surfaces 14 and 15 and a bottom or lower end 16 intermediate the surfaces 14 and 15. The user 18 of the apparatus 10 would situate his or her feet 20 in position by the instep portion 22, as hereinafter explained, while on the floor 24 in the operative position of the apparatus 10.

The apparatus 10 comprises frame means 25 having oppositely disposed sides 26 and adapted to be removably secured to the door 12. The frame means 25 comprises a base member 28 having spaced apart terminal ends 30 extending in a plane substantially parallel to the surfaces 14 and 15 of the door 12. The base 28, having an inner surface or wall 32 and outer surface or wall 34, is adapted to extend below the bottom 16 of the door 12. The frame means 25 is produced having a rigid construction and may be fabricated from metallic or plastic material.

A front member 36 is provided having an oppositely disposed lower end 38 and an upper end 40 and spaced apart inner wall 42 and outer wall 43 intermediate the sides or ends 26. The lower end 38 extends upwardly from the base 28 along the terminal end 30, and the inner wall 42 is adapted to extend in overlapping relation with one of the surfaces 14 of the door 12.

A rear member 44 is provided having an oppositely disposed lower end 46 and an upper end 48 and spaced apart inner wall 50 and outer wall 52 intermediate the sides or ends 26. The lower end 46 extends upwardly from the base 28 along the terminal end 30, and the inner wall 50 is adapted to extend in overlapping relation with one of the surfaces 15 of the door 12.

The inner walls 42 and 50 are oppositely disposed with respect to each other defining a space therebetween greater than the width of the door defined by the surfaces 14 and 15 so as to readily permit the positonment of the door 12 therebetween. In this manner the frame means 25 extends below and on each side of the door 12. The inner walls 42 and 50 may extend in substantially parallel spaced relationship to each other, and the front member 36 and rear member 44 are integrally formed with the base 28.

Figure 2:
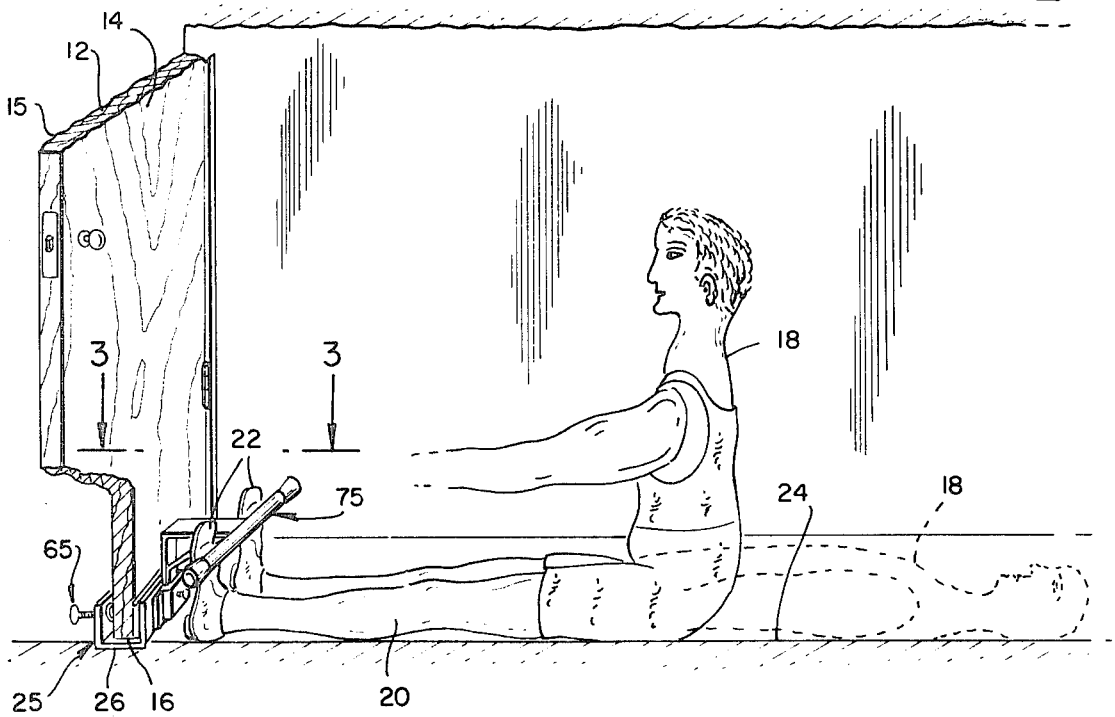
FIG. 2 is a perspective view, partially in section, illustrating the sit-up exercise apparatus of the present invention assembled with a door, or the like, and in use by a user doing sit-up exercises.

Accordingly, the frame means 25, as defined above, is readily placed in the position illustrated in FIG. 2 by initially opening the door 12 and sliding the frame means 25 into the desired position. Once in the postion shown the frame means is releasably retained in place relative to the door 12 for the intended use of the sit-up apparatus 10.

The sit-up apparatus 10 includes engaging means 55 secured to the inner wall 42 of the front member 36. The engaging means 55 may be fabricated from a relatively soft material, such as rubber, having a contacting edge 56 so as to provide a surface for engagement with surface 14 of the door 12.

The engaging means 55 may include a complete sheet extending substantially across the full width of the front member 36. It may be secured to the inner wall 42 by an adhesive if so desired.

Clamping means 65 is operatively connected to the rear member 44 and extends inwardly of the inner wall 50 for releasably clamping the surface 15 of the door 12, such that the frame means 25 is fixedly secured to the door at a selected position thereon and may be readily removed from securement therewith by releasing the clamping means 65.

The clamping means 65 includes a locking element 66, a pair of locking elements 66 may be utilized independently adjustable, and comprises a threaded section 68 extending in threaded engagement through the rear member 44 with a shoe 70 at one end of the threaded section 66 for abutting engagement with the surface 15 of the door 12 and a handle 72 at the opposite end of the threaded section 68 so as to facilitate adjustment thereof.

The shoe 70 is pivotally mounted with respect to the threaded section 66 so as to permit angular displacement relative thereto such that abutting engagement with the surface 15 of the door 12 may be obtained. The shoe 70 has a forward end 73, and the forward end 73 has a resilient portion 74 thereon to readily engage the surface 15 of the door 12 without marring same.

Supporting means 75 is provided and extends outwardly from the front member 36 on the frame means 25 and is adapted to extend at a height above the base 28 so as to be readily engageable by the feet 20 of the user 18 of the sit-up apparatus. The supporting means 75 comprises a support element 76, which may be tubular, extending in a plane substantially parallel to the front member 36 for engagement by the instep 22 of the user 18 of the sit-up apparatus 10. A sleeve 77 may be provided on each end of support element 76, and may be fabricated from a soft rubber or similar type material. A bracket 78 is rigidly secured to the support element 76. The bracket 78 may include an upper rib 79 an angular or lower rib 80, and a vertically extending support rib 81. The support rib 81 may include a pair of overlapping sections hereinafter described and terminate in a free end 83.

In this manner the sit-up exercise apparatus 10 may be utilized with a variety of doors that may differ in thickness and even if the spaced surfaces 14 and 15 are not parallel to each other. The clamping means 65 permits the assembly 10 to be readily adjusted to a different size door. The word "door" as used herein further includes any other structure that would accomplish the same end purpose, i.e. a portion of a fence, etc. It will be appreciated that the assembly 10 is easily and quickly secured in place without the need of any tools. In this manner both a child or adult can easily assemble the apparatus 10, as well as disassemble same, with a door 12.

Figure 4:
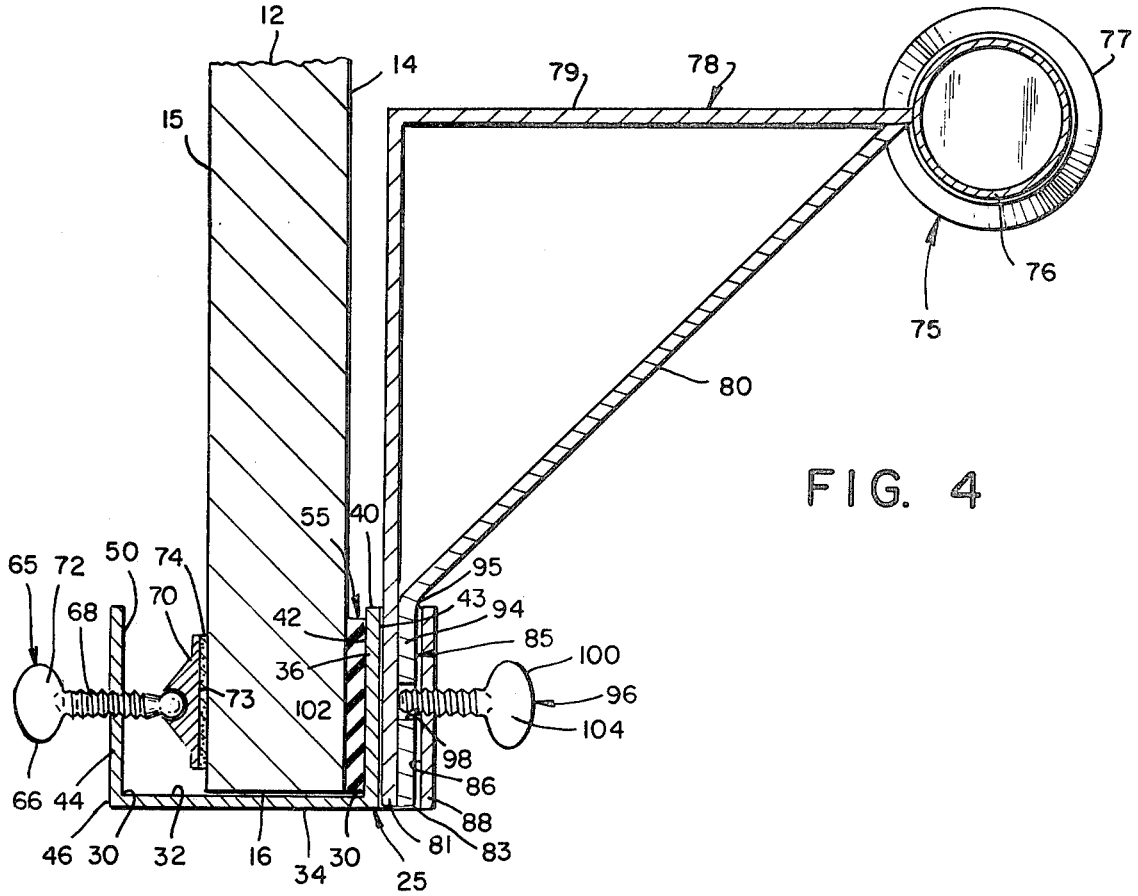
FIG. 4 is a sectional view taken along lines 4—4 of FIG. 3.

Referring to FIG. 4 there is illustrated the coupling means 85 for releasably securing the supporting means 75 to the frame means 25 so as to permit the supporting means 75 to be disassembled therefrom when the sit-up apparatus 10 is not in use such that the frame means 25 may remain assembled with the door 12.

This permits storage of the supporting means 75 when the assembly 10 is not in use. The coupling means 85 comprises a vertically extending recess 86 provided on the front member 36 from substantially the upper end 40 thereof and may extend down to the outer surface 34. The recess 86 may have a free or terminal end 87. The recess or channel 86 may be formed by a front panel 88, and a pair of side panels 90 extending substantially normal to the front member 36. The side panels 90 may be integrally formed with end panels 92 that are welded or otherwise secured to the front member 36.

The bracket 78 has the upper rib 79 extending from the support element 76 and terminating in the downwardly extending lip or support rib 81. The support rib 81 is adapted to be received within the recess 86 in interlocking relationship therewith. The lower rib 80 terminates in a neck 94 which is adapted to extend in abutting engagement with the support rib 81 over a portion thereof so as to form a rigid connection for the supporting means 75. The neck 94 joins the lower rib 80 at junction 95 which may abut against the free end 87 when the support element 76 is fully positioned within the recess 86. Accordingly in the inoperative position of the apparatus 10 the supporting means 75 is disassembled and stored for when use is required.

Figure 3:
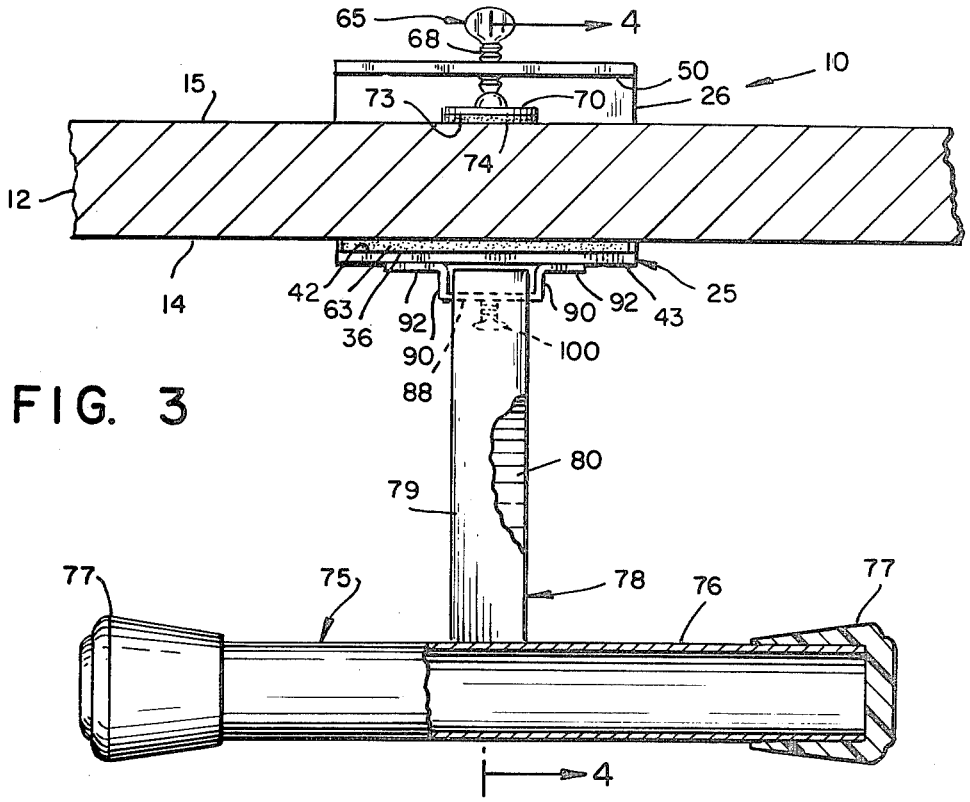
FIG. 3 is a top plan view in section taken along lines 3—3 of FIG. 2.

The operative position of the assembly 10 being as illustrated in FIGS. 2–4. In the inoperative position of the apparatus 10 the supporting means 75 is removed for storage until use of the apparatus 10 is desired. To maintain the assembled operative relationship locking means 96 is provided and may include an aperture 98 in the support rib 81 and neck 94. A threaded fastener 100 is threadably secured in front panel 88 and is in alignment with the aperture 98 when the bracket 78 is properly assembled with the front member 36. The threaded fastener has a front end 102 and a finger gripping area 104. The front end 102 is adapted to be received within the aperture 98, thereby preventing vertical movement of the support rib 81 which is seated within the recess 86.

Accordingly, the necessary compactness of the assembly 10 both in shipment, storage and use thereof is provided in the operative and inoperative positions thereof. If desired additional apertures 98 may be provided to permit vertical adjustment of the support rib 81 at different elevational levels.

The recess 86 may be substantially centrally located intermediate the sides 26 of the frame means 25. In addition the recess 86 may be of a rectangular or other configuration and the support rib 81 having a matching configuration so as to obtain a telescopic relation therebetween. The recess 86 may also extend vertically substantially the distance between the upper end 40 and lower end 46. The bracket 78 is designed and constructed to take the load applied thereto when the individual using the apparatus 10 applies the force of his or her instep portion 22 against the supporting means 75.

Figure 5:
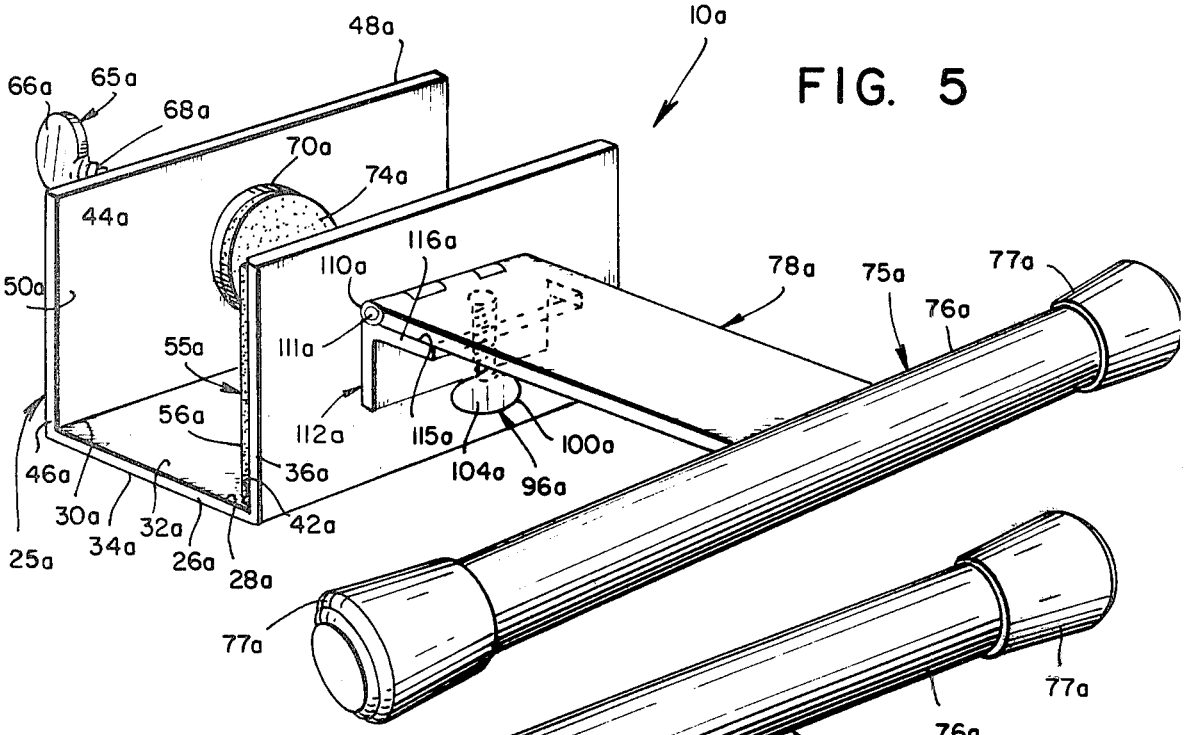
FIG. 5 is a perspective view of the sit-up exercise apparatus in accordance with another embodiment of the present invention shown in an operative position.
Figure 6:
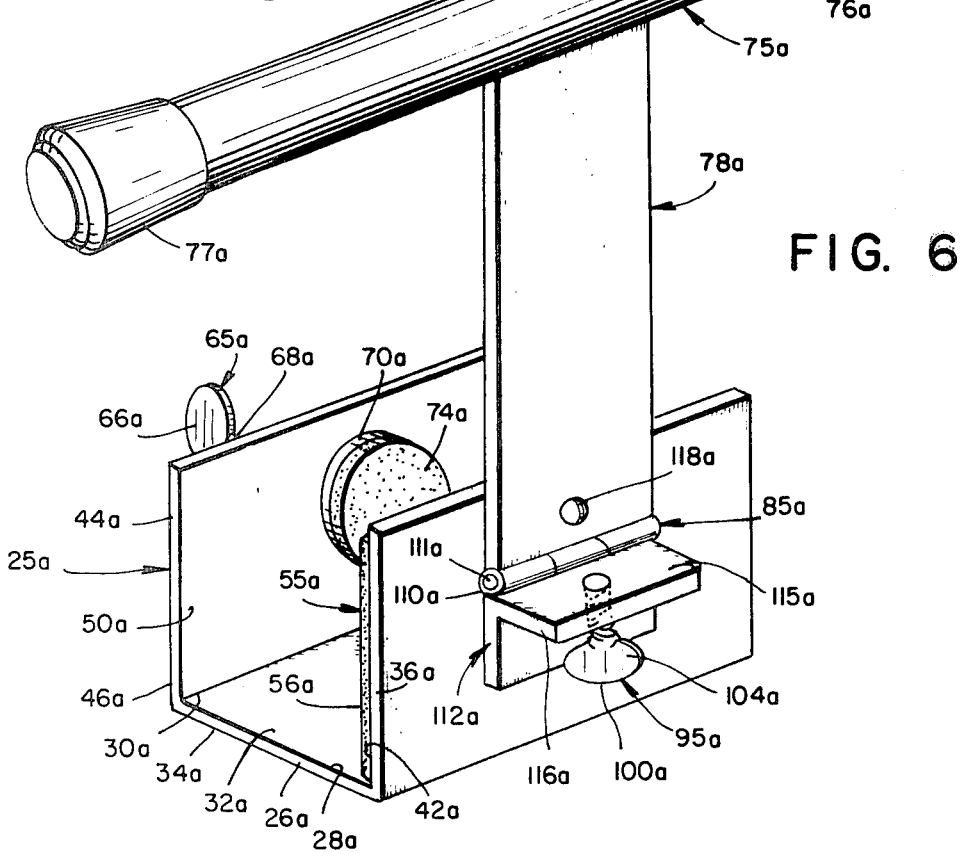
FIG. 6 is a perspective view similar to FIG. 5 with the apparatus in its inoperative or stored position.

There is illustrated in FIGS. 5 and 6 another embodiment of the apparatus **10*a* in which the supporting means 75*a* is pivotally connected by the coupling means 85*a* to the frame means 25*a*. In this manner the apparatus 10*a* is in its operative position in FIG. 5 and in its inoperative position in FIG. 6**.

In this manner by providing angular displacement or the bracket **78*a* the supporting means 75*a* is quickly and easily brought from one position to another. In the inoperative position the supporting means 75*a* may extend adjacent to one side of the door surface and above the upper ends 40*a* of the frame means 25*a*. When the user decides to do exercise he or she rotates the supporting means 75*a* which is hingably secured by hinge 110*a*. The hinge 110*a* having a hinge pin 111*a* connects one end of the bracket 78*a* to the front member 36*a***.

To stop the travel of the supporting means **75*a* at a given elevation limit means 112*a* is provided. The limit means 112*a* may be connected to the frame means 25*a*, as is illustrated or on the bracket 78*a* if so desired. The limit means 112*a* includes a limit platform or surface 115*a* which is part of flange or stop 116*a*, against which the bracket 78*a* comes to rest in the operative position of the assembly 10*a***.

The locking means **96*a* may threadably extend through flange 116*a* so as to mate with a threaded aperture 118*a* in the bracket 78*a*. The threaded fastener 100*a* is secured in the aperture 118*a* by the gripping area 104*a*. In this manner in the operative position the locking means 96*a* is used during the exercise time and thereafter to avoid possible tripping over the outwardly extending supporting means 75*a* it is folded upwardly to the position in FIG. 6. In this manner the assembly 10*a*** is easily and quickly placed in its storage or non-use position or in its position for use.

Although illustrative embodiments of the invention has been described in detail herein with reference to the accompanying drawings, it is to be understood that the invention is not limited to the precise embodiments, and that various changes and modifications may be effected therein without departing from the scope or spirit of the invention.

I claim:

1. A sit-up exercise apparatus to be utilized in conjunction with a door having spaced apart vertically extending surfaces and a bottom intermediate said surfaces, said apparatus comprising:

A. frame means adapted to be removably secured to the door, said frame means comprising:

(1) an elongated base adapted to extend below said bottom of the door, (2) front and rear members with oppositely disposed sides, each one of said members having a lower end connected to said base and an oppositely disposed upper end with spaced apart inner and outer walls intermediate said ends, said inner walls adapted to extend in overlapping relation with said surfaces of the door, and (3) said inner walls oppositely disposed with respect to each other defining a space therebetween greater than the width of the door defined by said surfaces so as to readily permit the positionment of the door therebetween, B. clamping means operatively connected to one of said members and extending inwardly of said inner wall for releasably clamping one of said surfaces of the door, such that said frame means is fixedly secured to the door at a selected position thereon and may be readily removed from securement therewith by releasing said clamping means, C. supporting bar means extending generally parallel to and outwardly from one of said members on said frame means at a height above said bottom of the door so as to be readily engageable by the feet of the user of the sit-up exercise apparatus, D. coupling means for securing said supporting means to said frame means so as to permit said supporting means to be assembled in the operative position when the sit-up apparatus is in use to a disassembled position such that said frame means may remain assembled with the door when the sit-up apparatus is not in use, said coupling means comprises:

(1) a recess substantially centrally located intermediate said sides and defined by a front panel and a pair of side panels extending substantially normal to said member for maintaining said front panel in spaced relationship to said member for forming said recess, said front panel having a free open end, and (2) a bracket secured to said supporting means and adapted to be received within said recess in said assembled position and removed from said recess in said disassembled position, E. said bracket includes:

(1) an upper rib extending in a substantially horizontal plane from said supporting means, (2) a support rib coupled at one end to said upper rib and extending downwardly and substantially perpendicular therefrom, (3) a lower rib angularly disposed relative to said upper rib and said support rib and secured therebetween, (4) said lower rib including a neck portion extending in fixedly coupled overlapping relationship with said support rib along a portion of the length thereof with a junction therebetween, said support rib and said neck portion having a complementary configuration as said recess and adapted to be received within said recess in telescopic relation therewith, (5) said junction is adapted to abut against said free end when in assembled position in said recess, and (6) said recess extends vertically on said member substantially the distance between said upper and lower ends thereof, F. locking means for releasably securing said supporting means in fixed relation to said frame means in said assembled position, G. said locking means includes:

(1) a threaded fastener extending through said front panel, and (2) an aperture extending within said bracket and adapted to receive one end of said fastener therein when said junction abuts against said free end of said recess such that interlocking relationship with said support rib is obtained whereby vertical movement of said supporting means relative to said frame means is prevented during use of the exercise apparatus, H. said clamping means comprises an adjustable locking element having a threaded section extending in threaded engagement through one of said members with a shoe at one end of said section for abutting engagement with said surface of the door and a handle at the opposite end of said threaded section so as to facilitate adjustment thereof, and I. said supporting means includes a support element extending in a plane substantially parallel to said members for engagement by the insteps of the user of the sit-up apparatus and having spaced apart free ends.

2. A sit-up apparatus as in claim 1, wherein said shoe is pivotally mounted with respect to said threaded section so as to permit angular displacement relative thereto such that abutting engagement with said surface of the door may be obtained.

3. A sit-up apparatus as in claim 2, wherein said shoe has a forward end, and said forward end has a resilient portion thereon to readily engage said surface of the door without marring same.

4. A sit-up apparatus as in claim 1, wherein said base and said front and rear members are integrally formed with each other.

5. A sit-up apparatus as in claim 1, wherein:

a. said engaging means and said supporting means are operatively connected to said front member, and b. said clamping means is operatively connected to said rear member.

6. A sit-up apparatus as in claim 1, wherein said inner walls extend in substantially parallel spaced apart relationship to each other.

7. A sit-up apparatus as in claim 1, including engaging means secured to said inner wall of one of said members, said engaging means having a contacting edge so as to provide a surface for engaging one of said surfaces of the door.

8. A sit-up apparatus as in claim 7, wherein said engaging means is formed of a resilient member.

9. A sit-up apparatus as in claim 1, wherein said frame means is fabricated from a metallic material.

10. A sit-up apparatus as in claim 1, wherein said coupling means is pivotally connected to said frame means so as to provide angular displacement of said supporting means between said operative position and said inoperative position.

11. A sit-up apparatus as in claim 10, wherein said coupling means includes:

a. a bracket secured to said supporting means, and b. a hinge for pivotally joining said bracket to said supporting means.

12. A sit-up apparatus as in claim 11, further including limit means for limiting the travel of said bracket from said inoperative position to said operative position.

13. A sit-up apparatus as in claim 12, wherein said supporting means extends adjacent to one of said surfaces of the door and above said upper end of said members in said inoperative position.

* * * * *